US006599138B1

(12) United States Patent
Yeo et al.

(10) Patent No.: US 6,599,138 B1
(45) Date of Patent: Jul. 29, 2003

(54) HIGH FREQUENCY BOARD-TO-BOARD CONNECTOR

(75) Inventors: Yong Kee Yeo, Singapore (SG); Mahadevan K Iyer, Singapore (SG); Edwin Lim, Singapore (SG); Ke Hor Seah, Singapore (SG); Weng Chiok Thong, Singapore (SG)

(73) Assignee: Institute of Microelectronics, Singapore (SG)

( * ) Notice: Subject to any disclaimer, the term of this patent is extended or adjusted under 35 U.S.C. 154(b) by 0 days.

(21) Appl. No.: 10/167,458

(22) Filed: Jun. 13, 2002

(30) Foreign Application Priority Data

Mar. 30, 2002 (SG) ..... 200201811

(51) Int. Cl.[7] ..... H01R 4/66; H01R 13/648
(52) U.S. Cl. ..... 439/108; 439/74
(58) Field of Search ..... 439/101, 108, 439/82, 74

(56) References Cited

U.S. PATENT DOCUMENTS 4,571,014 A * 2/1986 Robin et al. ..... 439/108
4,655,518 A * 4/1987 Johnson et al. ..... 439/108
4,664,458 A * 5/1987 Worth ..... 439/82
5,035,631 A * 7/1991 Piorunneck et al. ..... 439/108
5,120,232 A * 6/1992 Korsunsky ..... 439/108
5,183,405 A * 2/1993 Elicker et al. ..... 439/108
5,195,899 A * 3/1993 Yatsu et al. ..... 439/101
5,228,864 A * 7/1993 Fusselman et al. ..... 439/108
5,825,633 A * 10/1998 Bujalski et al. ..... 361/804
5,967,806 A * 10/1999 Patterson ..... 439/108
6,099,328 A * 8/2000 Nelson et al. ..... 439/101
6,184,460 B1 * 2/2001 Bertoncini ..... 174/35 R
6,382,988 B1 5/2002 Rugg et al. ..... 439/82
6,428,358 B1 * 8/2002 Figueroa et al. ..... 439/608

FOREIGN PATENT DOCUMENTS

EP 0 971 445 A2 6/1999

* cited by examiner

*Primary Examiner*—Lynn D. Feild
*Assistant Examiner*—Hae Moon Hyeon
(74) *Attorney, Agent, or Firm*—Nath & Associates PLLC; Harold L. Novick; Marvin C. Berkowitz

(57) ABSTRACT

The invention relates to a high frequency board-to-board connector for interconnecting electronic sub-assemblies. The high frequency board-to-board connector includes a row of conductive pins received in an insulative housing for connecting with receptacles of a design. Two discrete electronic sub-assemblies, for example PCBs, can be mechanically and electrically connected without the need for a gender male connector on one PCB and a corresponding gender female connector on the other PCB. A plurality of follower arms spaced apart along the grounding plate facilitates contact with a ground plane in the design to form a ground path. The ground path reduces electromagnetic coupling between any pair of conductive pins and consequentially lowering cross-talk noise. Furthermore, inductive parasitics of the conductive pins is reduced, further facilitating high frequency operations.

21 Claims, 15 Drawing Sheets

HIGH FREQUENCY BOARD-TO-BOARD CONNECTOR

FIELD OF INVENTION

The present invention relates generally to an electrical connector. In particular, the invention relates to an electrical connector for interconnecting electronic sub assemblies, for example printed circuit boards, for use in high-frequency operations.

BACKGROUND

Electronic sub-assemblies, for example printed circuit boards ('PCBs'), are interconnected using electrical connectors. Conventionally, the electrical connector is designed to address mechanical and reliability issues. The electrical connector typically comprises an array of pins connecting the signal bearing tracks of one PCB to another PCB. Due to technological advances, higher speed circuitries have arisen, in turn giving rise to higher speed digital signal transmissions. If not properly implemented, the reduction in the rise and fall time of high-frequency digital signals propagating on the PCB may lead to a compromise in signal integrity, for example cross-talk noise and signal distortions due to impedance mismatch. As the clock frequency of the signal increases, more energy is distributed over the higher frequency spectrum which consequently creates a greater demand for a larger bandwidth.

Since the electrical connector bridges the signal propagation paths between PCBs, it therefore affects the total bandwidth required for the entire interconnected paths.

Therefore, there is a need to design a high frequency board-to-board connector for replacing electrical connectors. It is important that the high frequency board-to-board connector should include a construction that provides a low insertion loss and the capability to reduce crosstalk noise between neighbouring pins.

Hence, this clearly affirms a need for a high frequency board-to-board connector.

SUMMARY

A high frequency board-to-board connector based on an embodiment of the invention, includes an array of conductive pins received in an insulative housing for connecting with a design. The conductive pins are conventional connecting pins that includes but are not limited to a type of encirclement compression (ECOM) pin for insertion into receptacles formed by plated vias in the design. As the conductive pins connects directly to vias, also known as through-holes, in the design, two discrete electronic sub-assemblies, for example PCBs, can be mechanically and electrically connected without the need for a connector on one PCB and a corresponding connector on the other PCB.

A grounding plate is coupled to the insulative housing. One or more arms extend from the grounding plate. The independent bending motion of each arm facilitates contact with the ground plane. The grounding plate and the ground plane are connected to form a ground path for reducing electromagnetic coupling between conductive pins during high frequency operations.

Therefore in accordance with a first aspect of the invention, there is disclosed a high frequency board-to-board connector for connecting with a design comprising:

an insulative housing having a design-mounting face;

a first conductive element received in the insulative housing for connecting to a corresponding second conductive element in the design, the first conductive element having a tail for coupling to a corresponding conductive pad on an electronic sub-assembly, the high frequency board-to-board connector being connectable to the electronic sub-assembly; and a grounding element for mounting onto the insulative housing, the grounding element comprising:

a grounding body; and one or more follower arms coupled to the grounding body, each follower arm being resiliently biased and for connecting to a ground plane in the design.

In accordance with a second aspect of the invention, there is disclosed a high frequency board-to-board connector for connecting with a design comprising:

an insulative housing having a design-mounting face;

a first conductive element received in the insulative housing for connecting to a corresponding second conductive element in the design, the first conductive element having a tail for coupling to a corresponding conductive pad on an electronic sub-assembly, the high frequency board-to-board connector being connectable to the electronic sub-assembly; and a grounding element for mounting onto the insulative housing, the grounding element comprising one or more follower arms for connecting to a ground plane in the design.

In accordance with a third aspect of the invention, there is disclosed a high frequency board-to-board connector for interconnecting a pair of designs comprising:

an insulative housing;

a first conductive element received in the insulative housing, the first conductive element having first and second distal ends, the first distal end for connecting to a corresponding second conductive element in one design, and the second distal end for connecting to a corresponding third conductive element in the other design; and a grounding element for mounting onto the insulative housing, the grounding element comprising:

a grounding body;

one or more first follower arms coupled to the grounding body for connecting to a ground plane in one design; and one or more second follower arms coupled to the grounding body for connecting to a ground plane in the other design.

BRIEF DESCRIPTION OF THE DRAWINGS

Embodiments of the invention are described hereinafter with reference to the following drawings, in which.

DETAILED DESCRIPTION

A high frequency board-to-board connector for interconnecting printed circuit boards is described hereinafter for addressing the foregoing problems.

Figure 6:
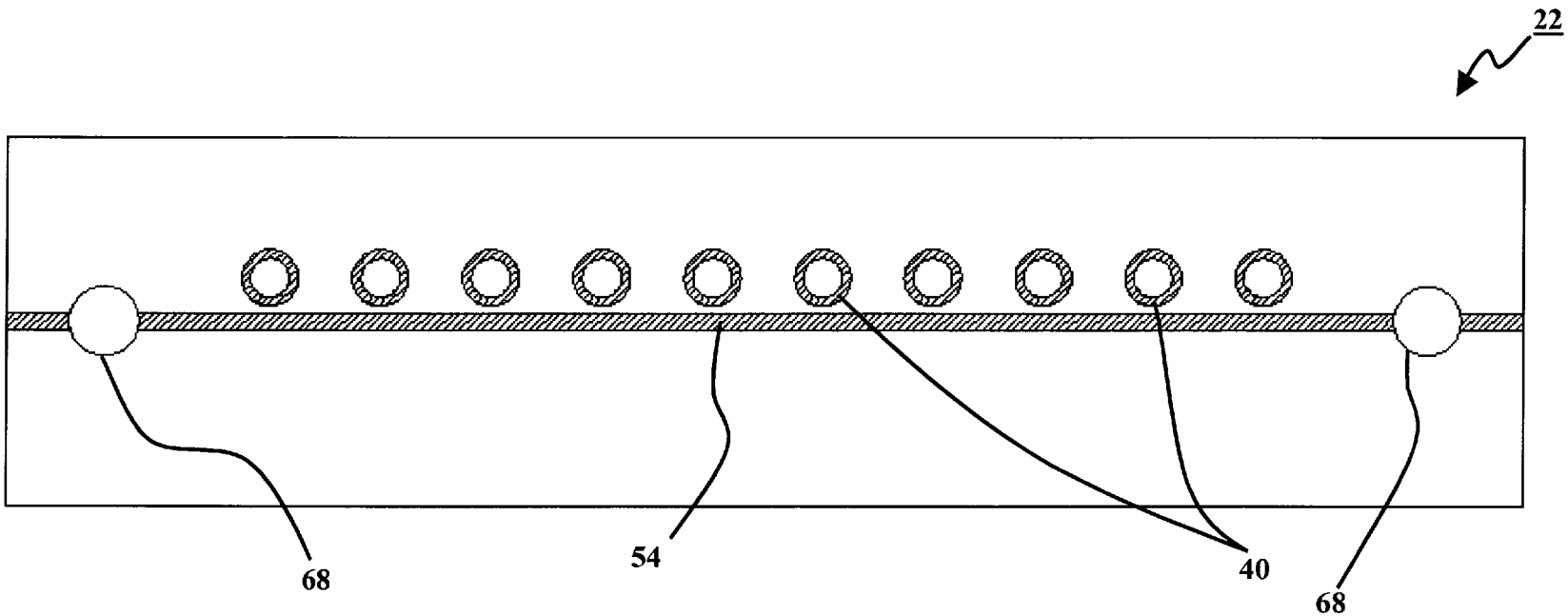
FIG. 6 is a plan view of a design for interconnecting with the high frequency board-to-board connector of FIG. 1.

A first embodiment of the invention, a high frequency board-to-board connector 20 for connecting to a design 22 (as shown in FIG. 6) is described with reference to FIG. 1, which shows a front view of the high frequency board-to-board connector 20 with a partial sectional view of an insulative housing 24, and FIG. 2, which shows a reverse view of the high frequency board-to-board connector of FIG. 1, with a grounding element 26 exposed. The design 22 includes a matrix of electrical tracks found on a conventional printed circuit board (PCB). The high frequency board-to-board connector 20 comprises of three main elements: the insulative housing 24, the grounding element 26 and a transverse row of conductive pins 34 as shown in FIG. 3.

Figure 1:
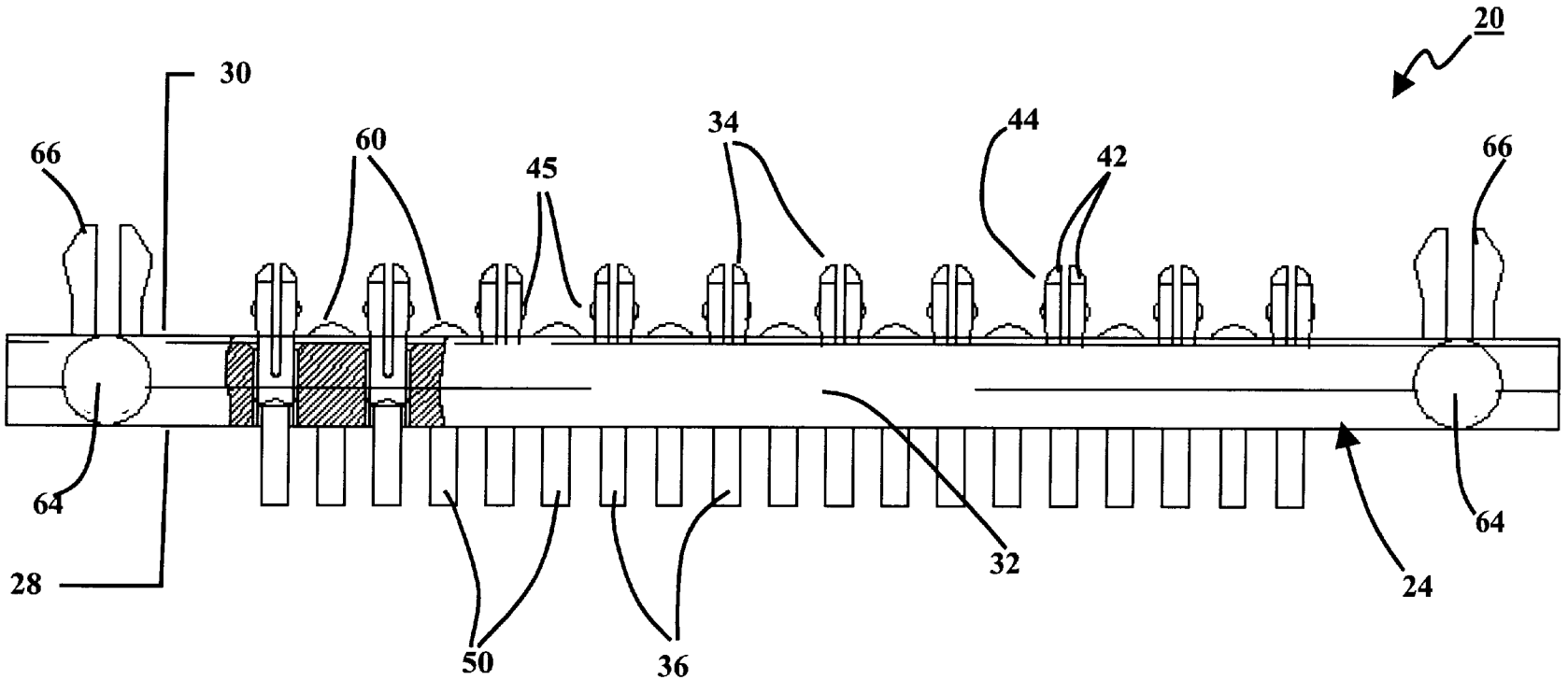
FIG. 1 is a front view of a high frequency board-to-board connector with a partial sectional view of an insulative housing.
Figure 2:
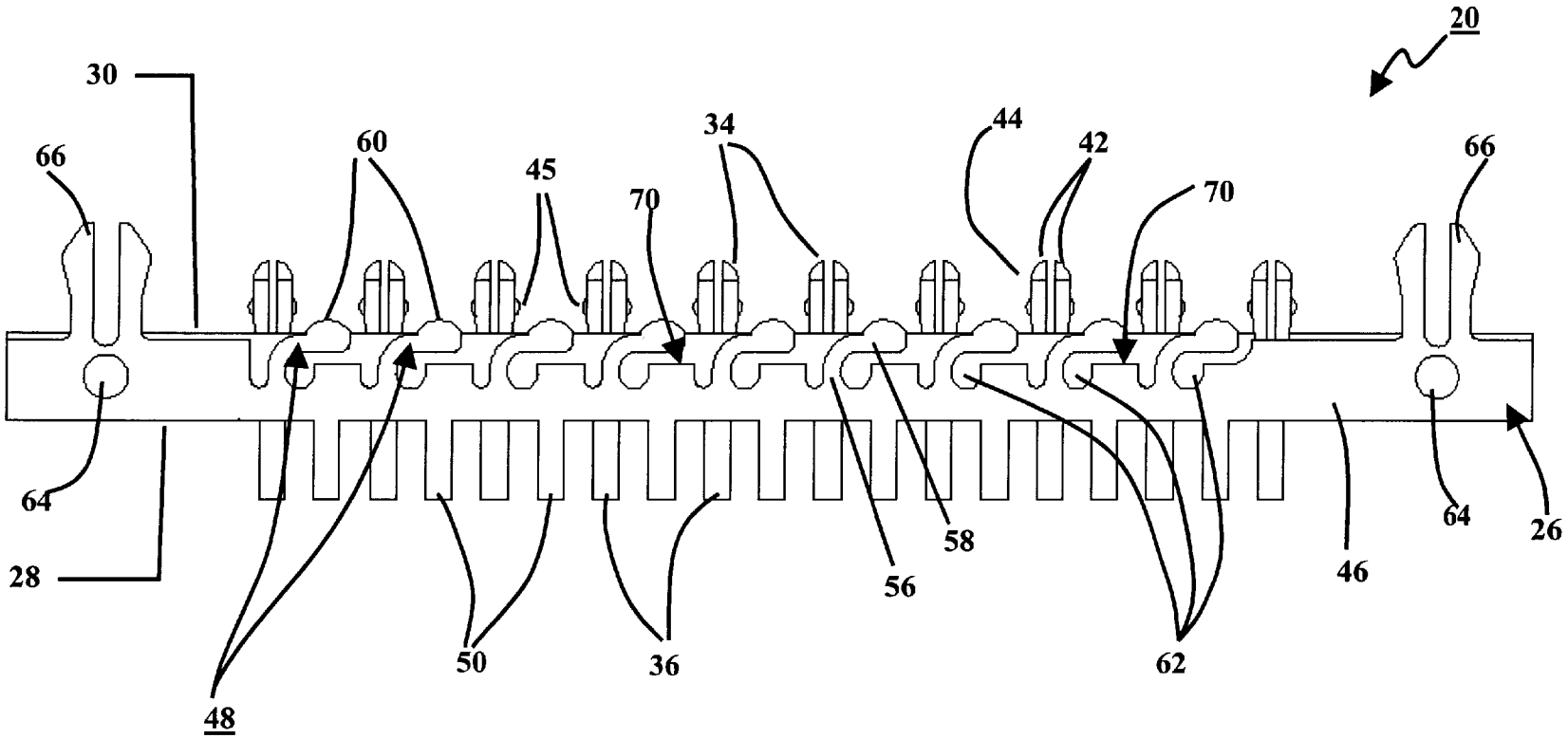
FIG. 2 is a reverse view of the high frequency board-to-board connector of FIG. 1, with a grounding element exposed.
Figure 3:
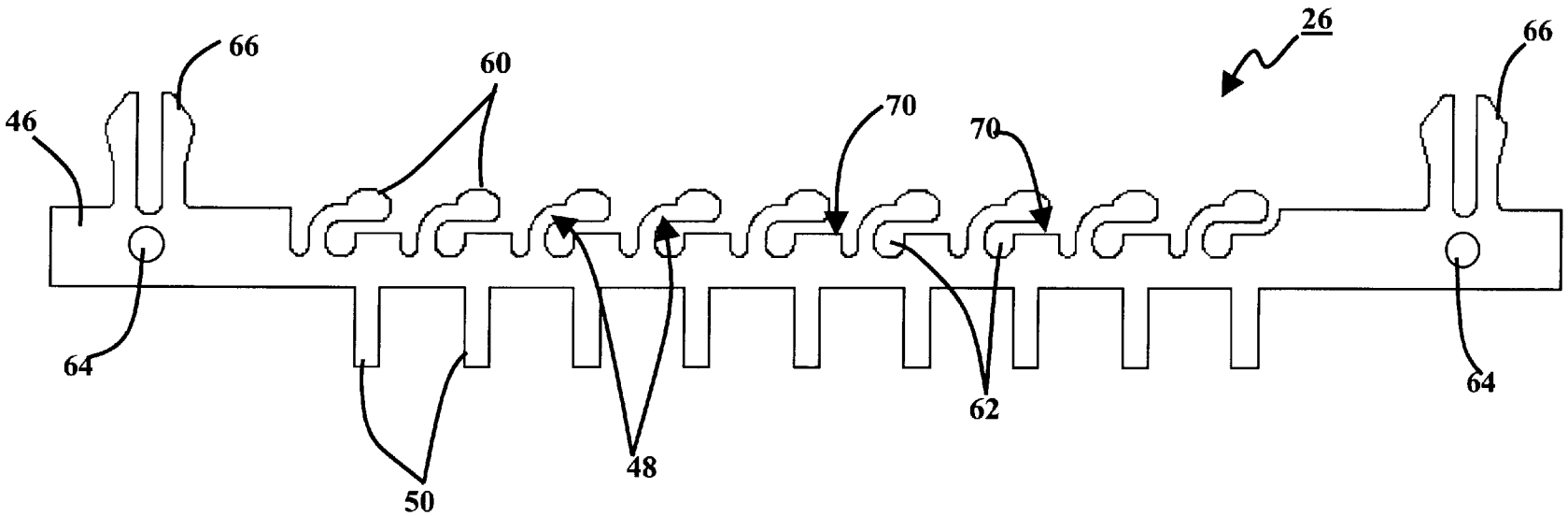
FIG. 3 is a front view of the grounding element of FIG. 2.
Figure 4:
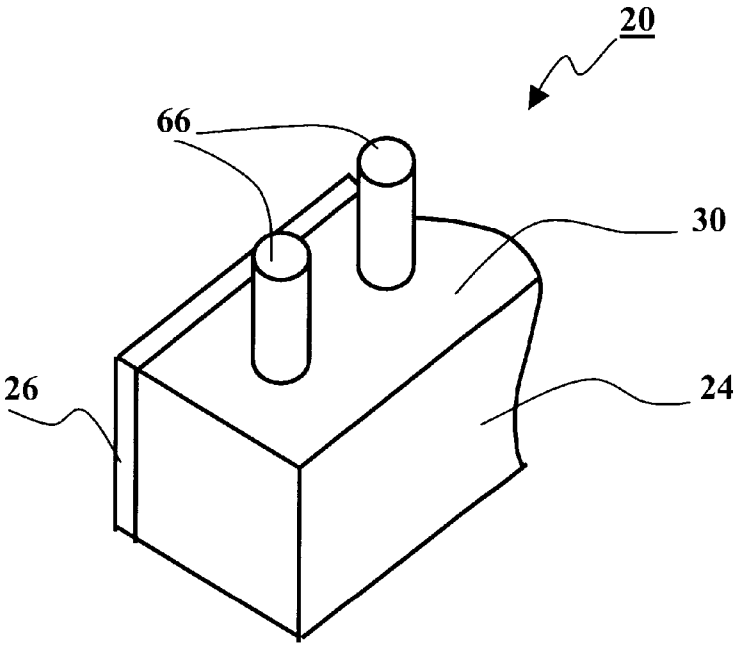
FIG. 4 is a partial perspective view of the high frequency board-to-board connector of FIG. 1.

Referring to FIGS. 1 and 2, the insulative housing 24 has a design-mounting face 28, a board-mounting face 30 generally parallel to the design-mounting face 28 and a periphery 32 being perpendicular to and constituting the circumference of the design-mounting face 28 and the board mounting face 30. The board-mounting face 30 is shown in FIG. 4.

Figure 5:
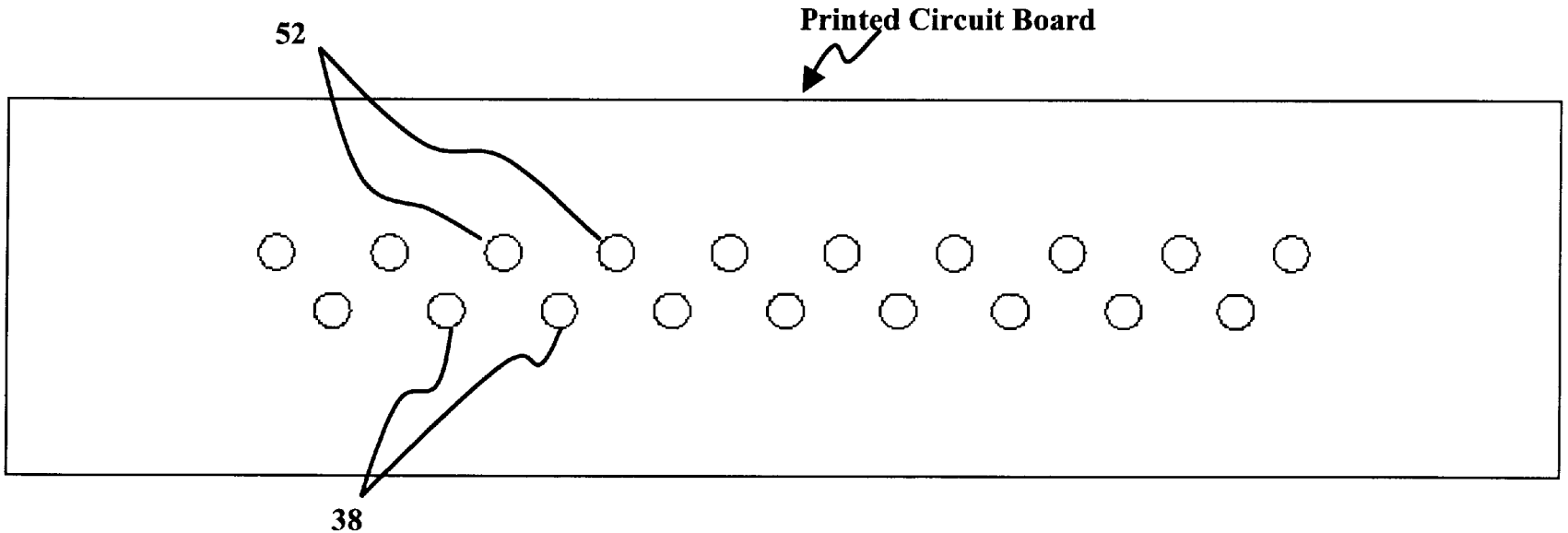
FIG. 5 is a plan view of a printed circuit board on which the high frequency board-to-board connector of FIG. 1 is mounted onto.

The transverse row of conductive pins 34 is received in the insulative housing 24. The transverse row of conductive pins 34 protrudes from the design-mounting face 28 of the insulative housing 24 with each conductive pin 34 being generally perpendicular to the design-mounting face 28. The conductive pins 34 are spaced apart. Each conductive pin 34 has a tail 36 for connecting to a corresponding conductive pad 38 on a printed circuit board (PCB) or the like electronic sub-assemblies shown in FIG. 5 which shows a plan view of a printed circuit board. The tail 36 is connectable to the corresponding conductive pad 38 by one of surface mount technology (SMT) or through-hole mounting.

Figure 7:
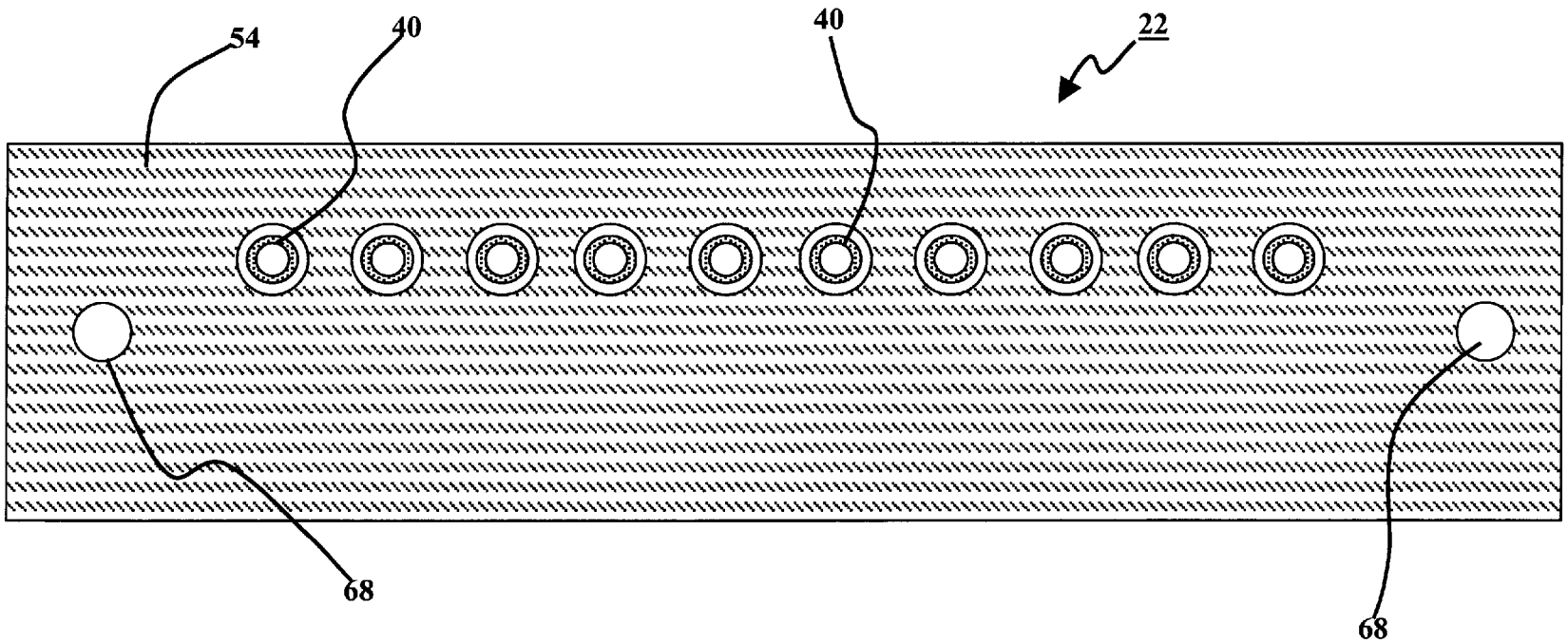
FIG. 7 is a reverse plan view of the design of FIG. 6.

FIG. 6 shows a plan view of the design 22 which includes a transverse row of receptacles 40 corresponding in quantity and positional arrangement to the row of conductive pins 34. FIG. 7 shows a reverse plan view of the design of FIG. 6. Each receptacle 40 is preferably a through-hole via, shaped and dimensioned for receiving the corresponding conductive pin 34 inserted therethrough. Referring to FIGS. 6 and 7, each conductive pin 34 comprises a pair of leads 42 terminating with a free end 44 of the conductive pin 34. The pair of leads 42 is circum-resiliant along a portion of the conductive pin 34 proximal to the free end 44. The outer side of each lead 42 includes a bump 45. The bump 45 facilitates contact with the receptacle 40 when the conductive pin 34 is received into the receptacle 40. The conductive pin 34 and receptacle 40 described above are conventional connecting pins that include but are not limited to those utilised in encirclement compression (ECOM) connectors. Each conductive pin 34 is preferably tapered at the free end 44 for facilitating insertion of the conductive pin 34 into a corresponding receptacle 40.

Figure 8:
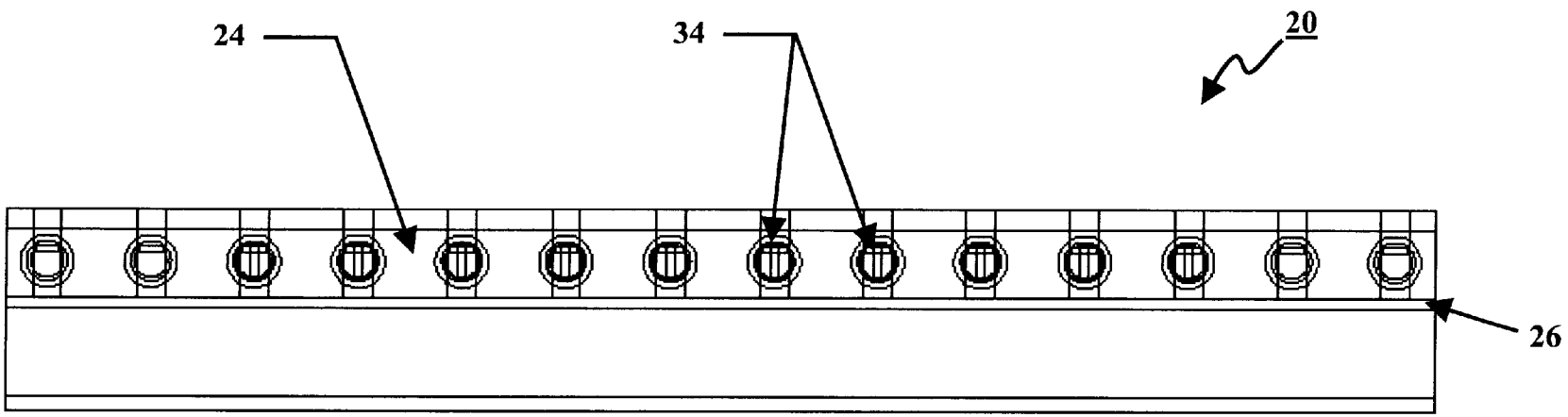
FIG. 8 is a plan view of the high frequency board-to-board connector of FIG. 1.
Figure 9:
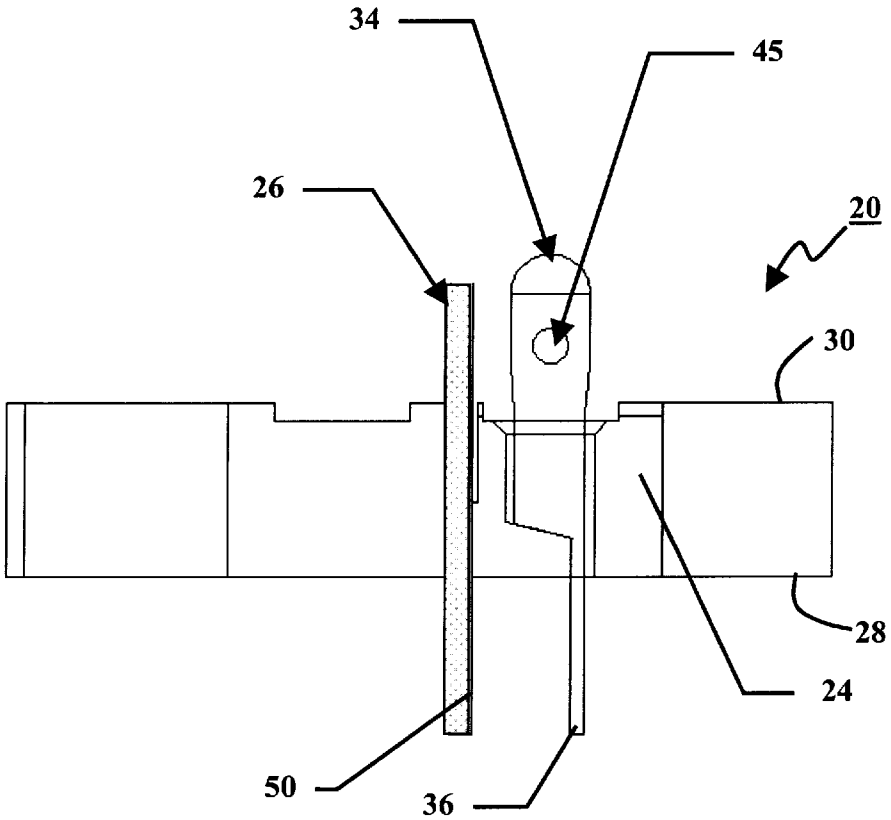
FIG. 9 is a partial side sectional view of the high frequency board-to-board connector of FIG. 1.
Figure 10:
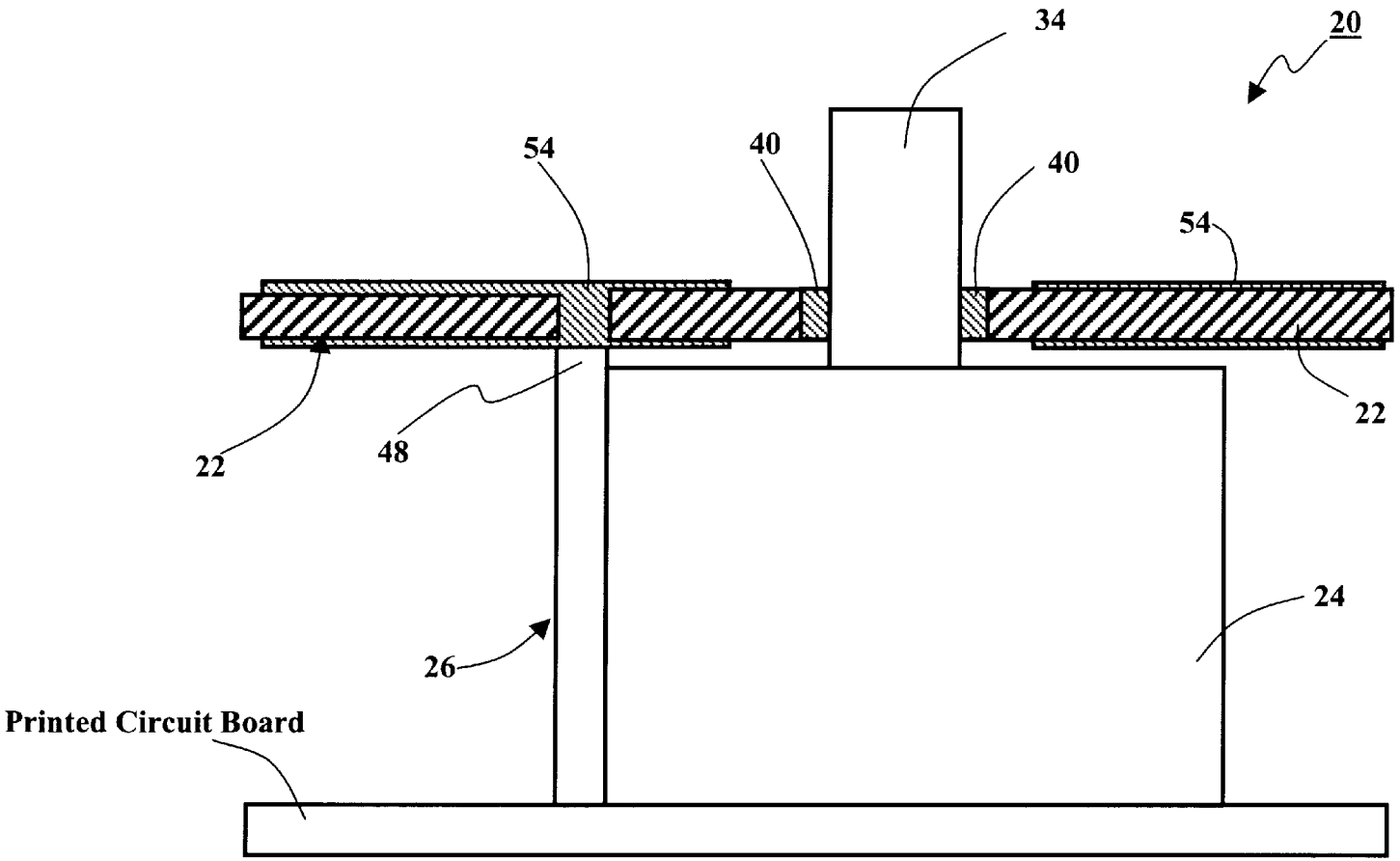
FIG. 10 is a partial side sectional view of the high frequency board-to-board connector of FIG. 1 mounted to the design of FIG. 6.

FIG. 8 shows a plan view of the high frequency board-to-board connector 20 and FIG. 9 shows a partial side sectional view of the high frequency board-to-board connector 20. The grounding element 26 as shown in FIG. 8 and FIG. 9, is generally planar and being coupled to the insulative housing 24 by slotting thereinto. The grounding element 26 includes a grounding body 46 and an array of follower arms 48 extending from the grounding body 46 as shown in FIG. 2. The grounding element 26 further includes a plurality of tails 50 for connecting with corresponding grounding pads 52 on the PCB by way of either surface mount technology or through-hole mounting process. Alternatively, each tail 50 is shaped as a follower arm (not shown) and adapted for connecting with the corresponding grounding pads 52 on the PCB by abutting thereto (also not shown). Each follower arm 48 is resiliently biased and bendable. The bending motion of one follower arm 48 is decoupled from and independent of the bending motion of another follower arm 48. The follower arm 48 is for connecting to a ground plane 54 in the design 22 of FIG. 6 as shown in FIG. 10. In situations when either the design 22 is oblique relative to the design-mounting face 28 of the insulative housing or the design 22 has an undulating surface, the decoupled motion of each follower arm 48 adapts to these situations to facilitate contact between the array of follower arms 48 and the ground plane 54. When the high frequency board-to-board connector 20 is displaced along an engagement axis (not shown) relative to the design 22 for engaging and thereby connecting each of the conductive pins 34 with the corresponding receptacle 40, the follower arms 48 deflect along the engagement axis for structurally adapting to the ground plane 54 in the design 22.

The follower arm 48 has a base end 56 and a free end 58 as shown in FIG. 2. The base end 56 of the follower arm 48 provides an interface between the follower arm 48 and the grounding body 46 of the grounding element 26. The follower arm 48 is generally elongated and extends away from the grounding body 46 at the base end 56 initially and overhanging as a cantilever generally transverse to the grounding body 46 subsequently for facilitating bending thereof when a force is applied to the free end 58. A ridge 60 having a round shape protrudes from the free end 58 for contacting with the ground plane 54. The grounding element 26 further includes a notch 62 formed adjacent to the base end 56 and free end 58. The notch 62 is preferably a concavity for reducing stress concentration at the interface when the follower arm 48 is being bent. The notch 62 not only improves the follower arm 48 travel, but also extends the life span of the follower arm 48 by substantially reducing the risk of the follower arm 48 breaking from the grounding body 46 due to stress concentration at the base end 56. An abutment 70 is formed adjacent to the notch 62 as shown in FIG. 3. The abutment 70 provides a mechanical limit for preventing the follower arm 48 from over-bending and consequently from being damaged.

Referring to FIG. 1, FIG. 2 and FIG. 8, the grounding element 26 is secured to the periphery 32 of the insulative housing 24 parallel to a plane formed by the transverse row of conductive pins 34 by encapsulating a portion of the grounding element 26 within the insulative housing 24 during plastic moulding of the insulative housing 24. A pair of holes 64 disposed at distal ends of the insulative housing 24 and grounding element 26 allows for a more secured retention of the grounding element 26 by the insulative housing 24. Alternatively, other forms of fastening means, for example bolts and nuts, can be employed.

The grounding element 26 further includes a pair of catches 66 extending perpendicularly from the grounding body 46 of the grounding element 26 as shown in FIG. 2. The pair of catches 66 is for insertion into a pair of corresponding apertures 68 constituting a portion in the design 22 which are also vias as shown in FIG. 6.

When inserted in the pair of apertures 68, the pair of catches 66 aligns the conductive pins 34 and follower arms 48 respectively to the receptacles 40 and the ground plane 54, consequentially securing the high frequency board-to-board connector 20 to the design 22 in the process. The grounding element 26 and the ground plane 54 align to form a ground path (not shown). Controlling the distance between the ground path and the conductive pins 34 permits impedance matching of preferably up to 50 ohms. The ground path reduces electromagnetic coupling between any pair of conductive pins 34 and consequentially lowering cross-talk noise. Inductive attenuation of the conductive pins 34 is also reduced, further facilitating high frequency operations.

A second embodiment of the invention, a high frequency board-to-board connector 20 as seen in FIG. 1, FIG. 2, FIGS. 8 to 10 and FIGS. 11 to 13, comprises of three main elements: an insulative housing 24, a grounding element 26 and at least a conductive pin 34. The descriptions in relation to the structural configurations of and positional relationships among the design 22, conductive pins 34, receptacles 40 and follower arm 48 with reference to FIGS. 1 to 10 are incorporated herein.

Figure 11:
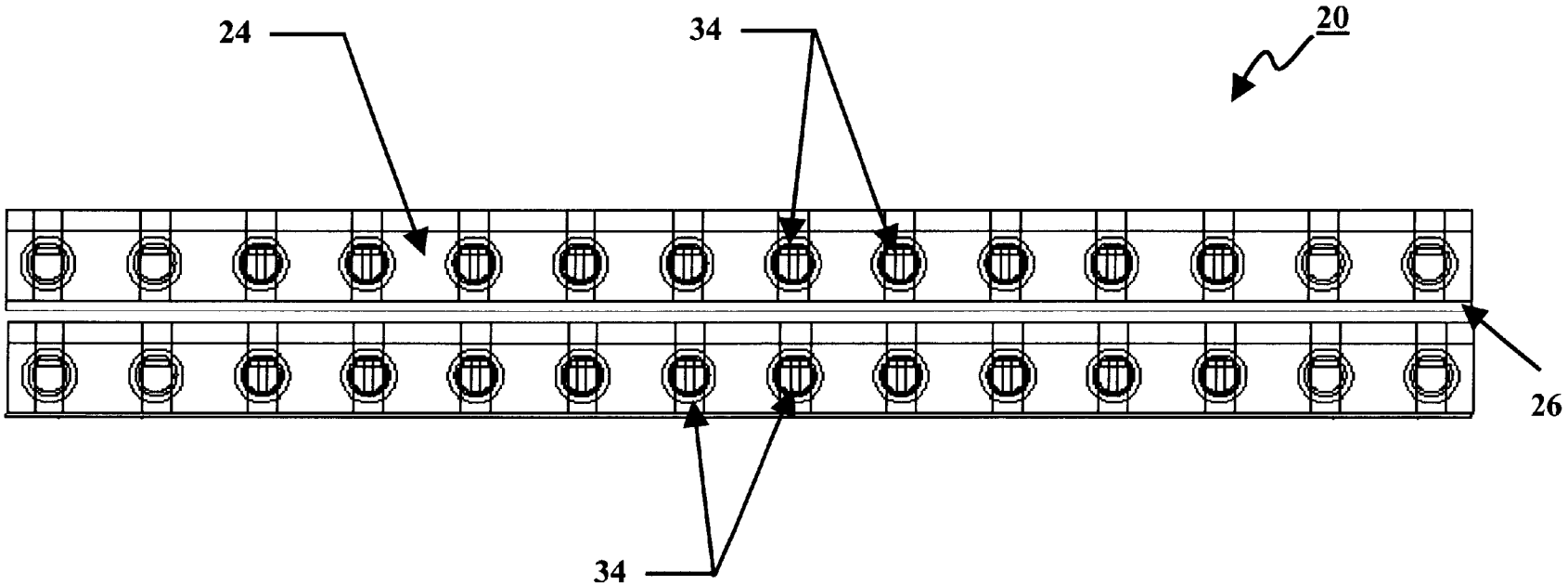
FIG. 11 is a plan view of the high frequency board-to-board connector of FIG. 1 with two transverse rows of conductive pins.
Figure 12:
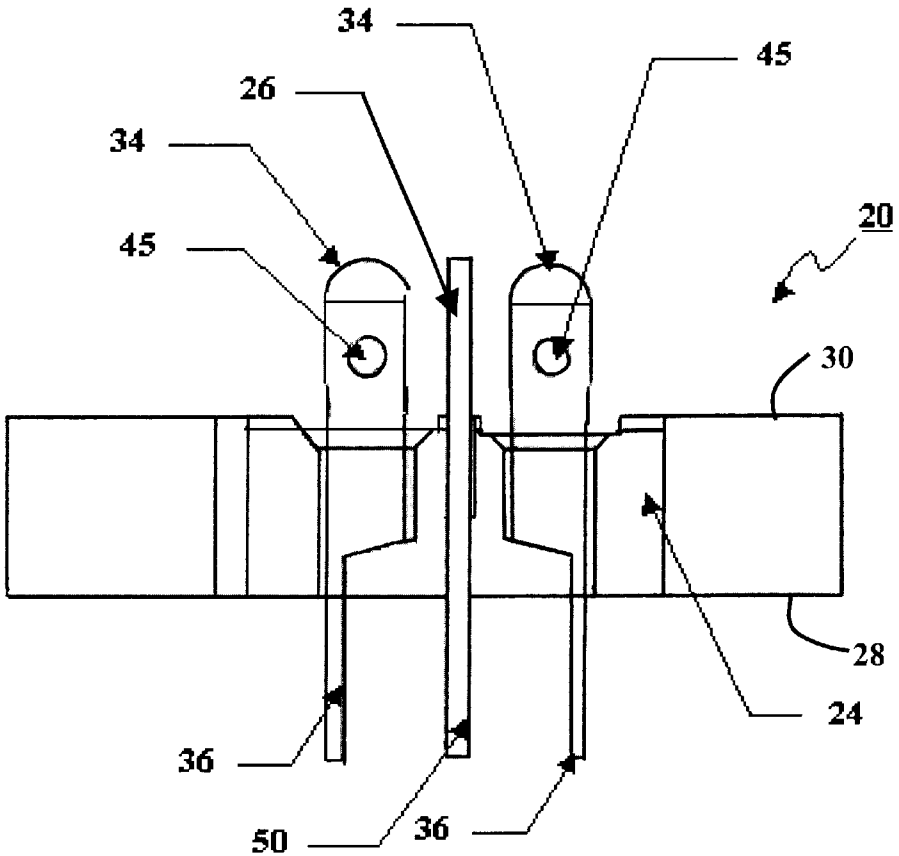
FIG. 12 is a partial side sectional view of the high frequency board-to-board connector of FIG. 1 with two transverse rows of conductive pins.
Figure 13:
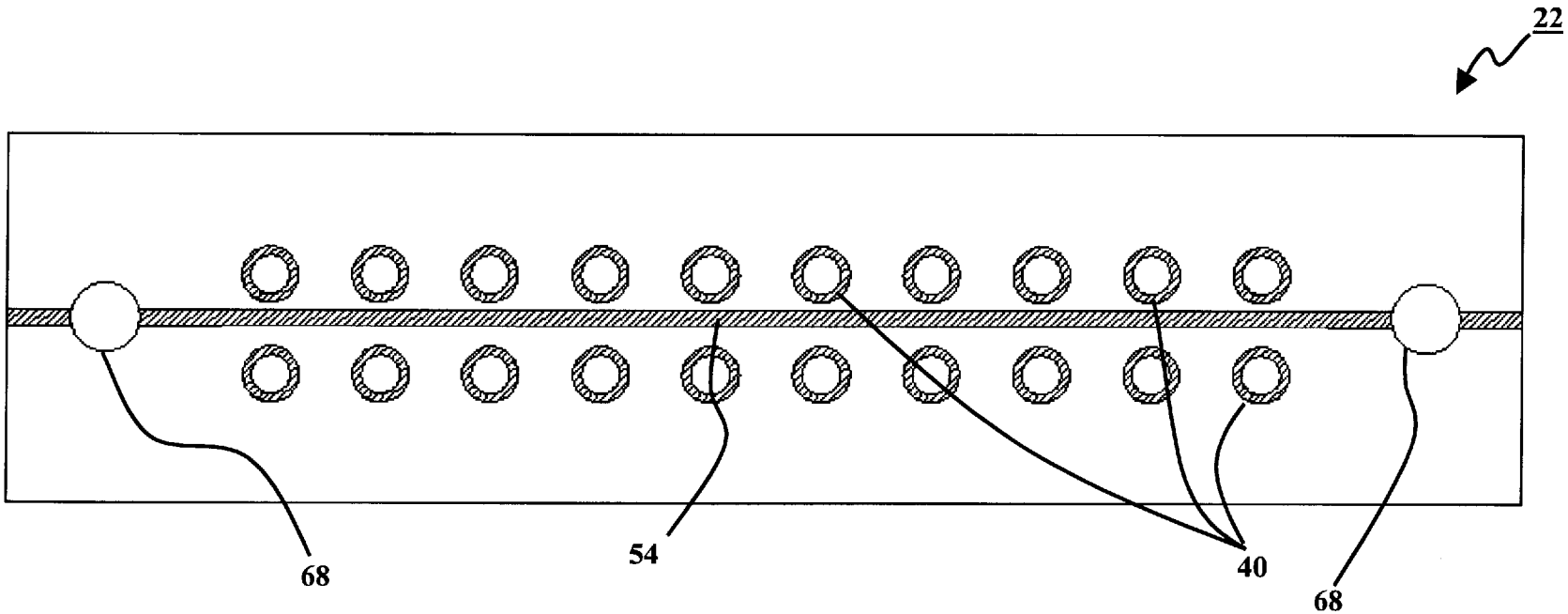
FIG. 13 is a plan view of a design for interconnecting with the high frequency board-to-board connector of FIG. 1 with two transverse rows of receptacles.

FIG. 11 shows a plan view of the high frequency board-to-board connector 20 comprising a pair of insulative housings 24. FIG. 12 shows the plan view of the high frequency board-to-board connector 20 of FIG. 11. Referring to FIG. 11 and FIG. 12, it is shown that one insulative housing 24 is mounted to each of two faces of the grounding element 26. The transverse row of conductive pins 34 received in one insulative housing 24 is parallel to and aligned with the transverse row of conductive pins 34 received in the other insulative housing 24 with the grounding element 26 forming an interface between both insulative housings 24. The two rows of conductive pins 34 are for connecting with two corresponding rows of receptacles 40 in the design 22 shown in FIG. 13. The ground plane 54 extends between the two transverse rows of receptacles 40 for connecting with the follower arms 48 of the grounding element 26.

A third embodiment of the invention, a high frequency board-to-board connector 20 as seen in FIG. 1, FIG. 2, FIGS. 8 to 10 and FIG. 14, comprises of three main elements: an insulative housing 24, a grounding element 26 and at least a conductive pin 34. The descriptions in relation to the structural configurations of and positional relationships among the design 22, conductive pins 34, receptacles 40 and follower arm 48 with reference to FIGS. 1 to 10 are incorporated herein.

Figure 15:
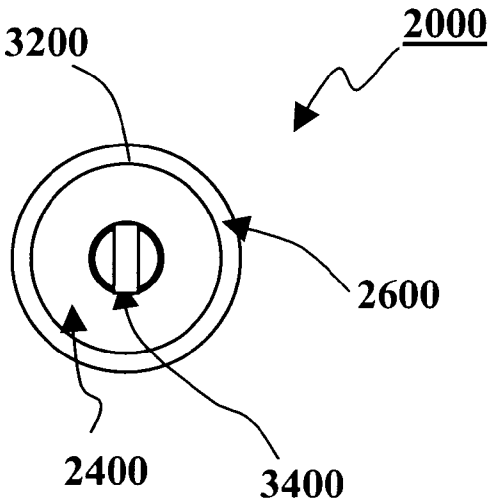
FIG. 15 is a plan view of the high frequency board-to-board connector of FIG. 1 with one conductive pin and a cylindrical shape.
Figure 14:
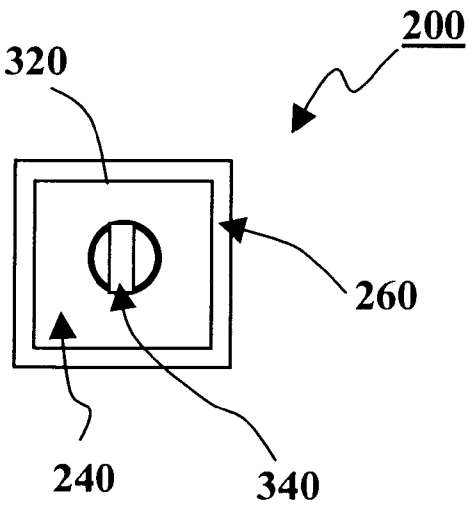
FIG. 14 is a plan view of the high frequency board-to-board connector of FIG. 1 with one conductive pin and a cube shape.

FIG. 14, shows a plan view of the high frequency board-to-board connector 200 with a single conductive pin 340 and a cube-shaped insulative housing 240, and FIG. 15, shows a plan view of the high frequency board-to-board connector 2000 with a single conductive pin 340 and a cylindrical insulative housing 2400. Referring to FIG. 14, one conductive pin 340 is received in the insulative housing [24] 240 which has a cube shape. The grounding element 260 is planar and is further shaped and dimensioned for mounting along a portion of the periphery 320 of the insulative housing 240 for generally inclosing the insulative housing 24. The design-mounting face and the board-mounting face (all not shown) are exposed to allow access to the conductive pins 340 and the corresponding tails (not shown). The grounding element 260 of FIG. 14 includes the follower arms 48 of FIG. 1. The follower arms are not shown in FIG. 14.

Alternatively, the insulative housing 2400 is generally cylindrical with the design-mounting face and the board-mounting face (all not shown) constituting two distal ends of the cylindrical insulative housing 2400 as shown in FIG. 15. The grounding element 2600 of FIG. 15 extends along the periphery 3200 of the insulative housing 2400 and includes the follower arms 48 of FIG. 1. The follower arms are not shown in FIG. 15.

A fourth embodiment of the invention, a high frequency board-to-board connector 20 as seen in FIG. 1, FIG. 2, FIGS. 7 to 9 and FIG. 16, comprises of three main elements: an insulative housing 24, a grounding element 26 and at least a conductive pin 34. The descriptions in relation to the structural configurations of and positional relationships among the design 22, conductive pins 34, receptacles 40 and follower arm 48 with reference to FIGS. 1 to 10 are incorporated herein.

Figure 16:
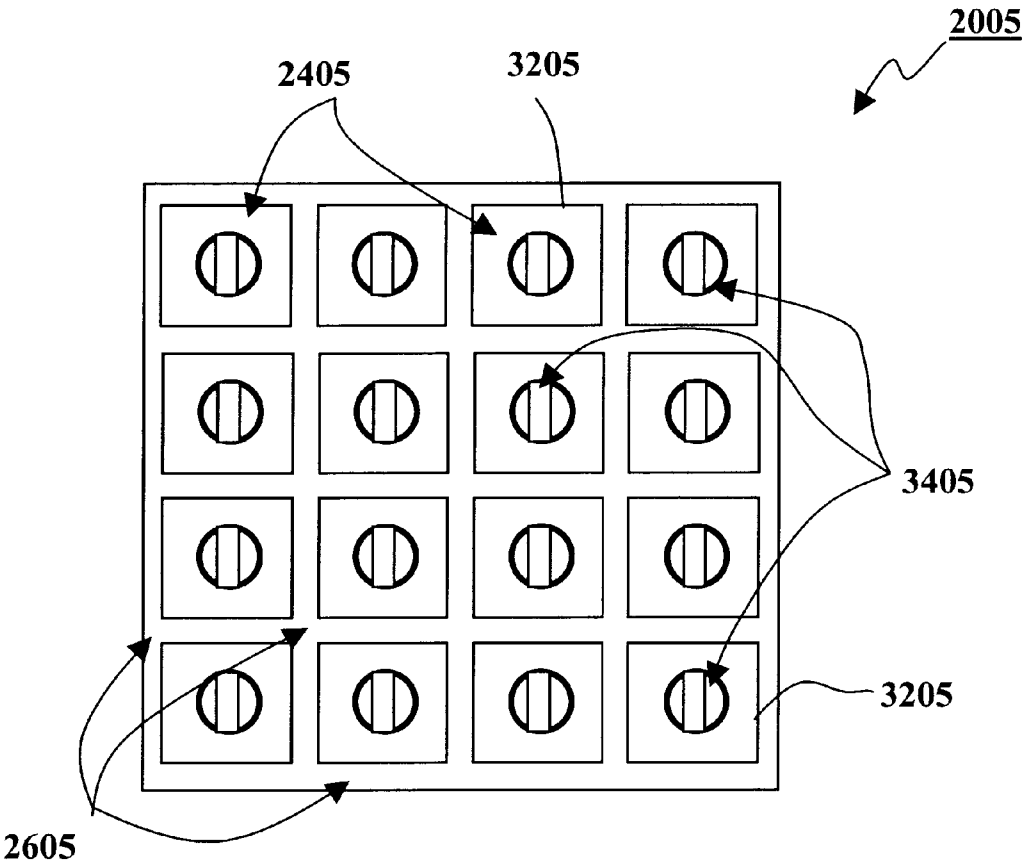
FIG. 16 is a plan view of the high frequency board-to-board connector of FIG. 1 with an array of insulative housing arranged in transverse rows and columns.

FIG. 16, shows a plan view of the high frequency board-to-board connector 2005 comprising an array of insulative housings 2405. Referring to FIG. 16, it is shown that the insulative housings 2405 are arranged into transverse rows and columns. The grounding element 2605 forms an interface between any pair of insulative housing 2405. One conductive pin 3405 is received in each insulative housing 2405. The grounding element 2605 of FIG. 16 extends along the periphery 3205 of the insulative housing 2405 and includes the follower arms 48 of FIG. 1. The follower arms 48 are not shown in FIG. 16.

In the foregoing manner, a high frequency board-to-board connector is described according to four embodiments of the invention for addressing the foregoing disadvantages of conventional high frequency board-to-board connectors. Although only four embodiments of the invention are disclosed, it will be apparent to one skilled in the art in view of this disclosure that numerous changes and/or modification can be made without departing from the scope and spirit of the invention.

What is claimed is:

1. A high frequency board-to-board connector for connecting with a design comprising:

an insulative housing having a design-mounting face;

a first conductive element received in the insulative housing for connecting to a corresponding second conductive element in the design, the first conductive element having a tail for coupling to a corresponding conductive pad on an electronic sub-assembly, the high frequency board-to-board connector being connectable to the electronic sub-assembly; and a grounding element for mounting onto the insulative housing, the grounding element comprising:

a grounding body; and one or more follower arms coupled to the grounding body, each follower arm being resiliently biased and for connecting to a ground plane in the design, wherein when the high frequency board-to-board connector is displaced along an engagement axis relative to the design for engaging and thereby connecting the first conductive element with the second conductive element, the follower arms deflect along the engagement axis for structurally adapting to the ground plane in the design.

2. The high frequency board-to-board connector as claimed in claim 1, the grounding element comprising at least one of a plurality of tails, each tail for connecting to a corresponding ground point on the electronic sub-assembly.

3. The high frequency board-to-board connector as claimed in claim 1, wherein the first conductive element is elongated and extending from the design-mounting face, the first conductive element being generally perpendicular to the design-mounting face of the insulative housing.

4. The high frequency board-to-board connector as claimed in claim 3, wherein the first conductive element is for insertion into the second conductive element having a conduit shaped and dimensioned for receiving the first conductive element therethrough, the first conductive element being circum-resiliant for facilitating contact with the second conductive element when received in the second conductive element.

5. The high frequency board-to-board connector as claimed in claim 4, wherein the first conductive element comprising a plurality of leads terminating with a free end of the first conductive element.

6. The high frequency board-to-board connector as claimed in claim 5, further comprising one or more projections disposed on an outer surface of the first conductive element, the projection for facilitating contact with the second conductive element when the first conductive element is received in the second conductive element.

7. The high frequency board-to-board connector as claimed in claim 5, wherein the free end of the first conductive element is tapered for facilitating insertion through the conduit of the second conductive element thereof.

8. The high frequency board-to-board connector as claimed in claim 1, the insulative housing comprising one or more transverse rows of a plurality of first conductive elements.

9. The high frequency board-to-board connector as claimed in claim 1, the grounding element comprising an array of follower arms, each follower arm being decoupled in motion from the other follower arm.

10. The high frequency board-to-board connector as claimed in claim 1, the follower arm having a base end and a free end, the base end being coupled to the grounding body of the grounding element and the follower arm being generally elongated to facilitate bending of a portion of the follower arm, the follower arm comprising:

a head coupled to the free end and being round-shaped for mating with the ground plane.

11. The high frequency board-to-board connector as claimed in claim 10, a notch formed adjacent to the base end and the free end of the follower arm, the notch being a concavity for reducing stress concentration when the follower arm is being bent.

12. The high frequency board-to-board connector as claimed in claim 11, further comprising an abutment formed adjacent to the notch, wherein when excessive force is applied to bend the follower arm, the follower arm abuts the abutment thereby preventing the follower arm from overbending.

13. The high frequency board-to-board connector as claimed in claim 1, further comprising a catch coupled to the grounding element for engaging onto a fixture, the fixture being coupled to the design, and the engaging of the catch to the fixture for aligning of the first conductive element to the corresponding second conductive element and the aligning of the follower arm to the ground plane.

14. The high frequency board-to-board connector as claimed in claim 1, wherein the grounding element is shaped and dimensioned for extending along a portion of the periphery of the insulative housing.

15. The high frequency board-to-board connector as claimed in claim 14, wherein the insulative housing is rectangularly shaped.

16. The high frequency board-to-board connector as claimed in claim 14, wherein the insulative housing is cylindrically shaped.

17. The high frequency board-to-board connector as claimed in claim 1, further comprising a pair of insulative housings, the grounding element disposed between the pair of insulative housings and interconnecting the pair of insulative housings.

18. The high frequency board-to-board connector as claimed in claim 1, further comprising an array of insulative housings, at least one of a plurality of any pair of insulative housings having the grounding element disposed therebetween and interconnecting the pair of insulative housings.

19. The high frequency board-to-board connector as claimed in claim 1, wherein the grounding element is generally planar.

20. A high frequency board-to-board connector for connecting with a design comprising:

an insulative housing having a design-mounting face;

a first conductive element received in the insulative housing for connecting to a corresponding second conductive element in the design, the first conductive element having a tail for coupling to a corresponding conductive pad on an electronic sub-assembly, the high frequency board-to-board connector being connectable to the electronic sub-assembly; and a grounding element for mounting onto the insulative housing, the grounding element comprising one or more follower arms for connecting to a ground plane in the design, wherein when the high frequency board-to-board connector is displaced along an engagement axis relative to the design for engaging and thereby connecting the first conductive element with the second conductive element, the follower arms deflect along the engagement axis for structurally adapting to the ground plane in the design.

21. A high frequency board-to-board connector for interconnecting a pair of designs comprising:

an insulative housing;

a first conductive element received in the insulative housing, the first conductive element having first and second distal ends, the first distal end for connecting to a corresponding second conductive element in one design, and the second distal end for connecting to a corresponding third conductive element in the other design; and a grounding element for mounting onto the insulative housing, the grounding element comprising:

a grounding body;

one or more first follower arms coupled to the grounding body for connecting to a ground plane in one design; and one or more second follower arms coupled to the grounding body for connecting to a ground plane in the other design, wherein when the high frequency board-to-board connector is displaced along an engagement axis relative to the design for engaging and thereby connecting the first conductive element with the second conductive element, the follower arms deflect along the engagement axis for structurally adapting to the ground plane in the design.

* * * * *

UNITED STATES PATENT AND TRADEMARK OFFICE

CERTIFICATE OF CORRECTION

PATENT NO. : 6,599,138 B1
DATED : July 29, 2003
INVENTOR(S) : Yeo et al.

It is certified that error appears in the above-identified patent and that said Letters Patent is hereby corrected as shown below:

Title page,
Item [73], Assignee, should read -- Institute of Microlectronics, Singapore (SG); and Ranoda Electronics Pte Ltd, Singapore (SG) --

Signed and Sealed this

Twenty-fifth Day of May, 2004

JON W. DUDAS
*Acting Director of the United States Patent and Trademark Office*